US010010188B2

(12) United States Patent
Hsu

(10) Patent No.: US 10,010,188 B2
(45) Date of Patent: Jul. 3, 2018

(54) ADJUSTABLE MATTRESS STRUCTURE

(71) Applicant: Han-Chung Hsu, Taipei (TW)

(72) Inventor: Han-Chung Hsu, Taipei (TW)

( * ) Notice: Subject to any disclaimer, the term of this patent is extended or adjusted under 35 U.S.C. 154(b) by 252 days.

(21) Appl. No.: 14/730,712

(22) Filed: Jun. 4, 2015

(65) Prior Publication Data

US 2016/0353899 A1 Dec. 8, 2016

(51) Int. Cl.
*A47C 27/06* (2006.01)

(52) U.S. Cl.
CPC ..... *A47C 27/061* (2013.01)

(58) Field of Classification Search
CPC ... A47C 23/002; A47C 23/007; A47C 23/043; A47C 23/0431; A47C 23/0435; A47C 23/0438; A47C 23/05; A47C 23/0507; A47C 27/04; A47C 27/06; A47C 27/061; A47C 27/062; A47C 27/063; A47C 27/065; A47C 27/066; A47C 27/07
USPC .. 267/75, 136, 80, 90, 91, 95, 97, 100, 103, 267/104, 112; 24/437, 439–441, 298, 24/300, 455, 457, 481–482, 485, 530, 24/531, 547; 5/716–717, 723, 728, 739, 5/659
See application file for complete search history.

(56) References Cited

U.S. PATENT DOCUMENTS 3,862,751 A * 1/1975 Schwaller ..... F16F 1/125 137/512.5
4,222,137 A * 9/1980 Usami ..... A47C 23/0435 5/697
4,827,546 A * 5/1989 Cvetkovic ..... A47C 27/061 297/DIG. 8
5,020,852 A * 6/1991 Marion ..... B62J 1/00 297/200
6,523,812 B1 * 2/2003 Spinks ..... A47C 27/001 267/166
6,986,182 B2 * 1/2006 Mossbeck ..... A47C 23/047 267/81
7,661,165 B2 * 2/2010 Piccinini ..... A47C 27/146 267/81
7,934,277 B1 * 5/2011 Shu ..... A47C 23/0435 5/690
8,375,492 B2 2/2013 Hsu
8,438,681 B2 * 5/2013 Viberg ..... A47C 23/0435 5/716
(Continued)

*Primary Examiner* — David E Sosnowski
*Assistant Examiner* — Rahib T Zaman
(74) *Attorney, Agent, or Firm* — Muncy, Geissler, Olds & Lowe, P.C.

(57) ABSTRACT

An adjustable mattress structure comprises a mattress body in which there are a plurality of hollow bases, a plurality of elastic support units, a plurality of adjustable positioning boards and a plurality of spring positioning bodies. Each of the elastic support units consists of a first encapsulated elastomer and a second encapsulated elastomer. The first encapsulated elastomer depends on spring positioning bodies to be fixed on one of the hollow bases so that the second encapsulated elastomer extends inside the hollow base. Each of the adjustable positioning boards is fixed inside a hollow base and used to receive a second encapsulated elastomer; the adjustable positioning boards in the hollow bases are situated at distinct positions by which the adjustable positioning boards make the elastic support units generate distinct resilient bearing capacities for adjustable mattress firmness supporting a body curve.

4 Claims, 8 Drawing Sheets

(56) References Cited

U.S. PATENT DOCUMENTS

| | | | | |
|---|---|---|---|---|
| 8,516,635 | B2 | 8/2013 | Hsu | |
| 8,613,119 | B2 | 12/2013 | Hsu | |
| 8,893,336 | B2 | 11/2014 | Hsu | |
| 8,978,183 | B1 * | 3/2015 | Richmond | A47C 27/064 5/655.8 |
| 8,984,689 | B1 * | 3/2015 | Hsu | A47C 23/0433 5/659 |
| 2002/0152554 | A1 * | 10/2002 | Spinks | A47C 27/064 5/655.8 |
| 2008/0276377 | A1 * | 11/2008 | Hsu | A47C 23/0435 5/727 |
| 2011/0303046 | A1 * | 12/2011 | Gentry | F16F 1/126 74/560 |
| 2012/0054968 | A1 * | 3/2012 | Hsu | A47C 23/0435 5/706 |
| 2012/0110744 | A1 * | 5/2012 | Hsu | A47C 23/0435 5/697 |
| 2013/0000049 | A1 * | 1/2013 | Hsu | A47C 23/0435 5/710 |
| 2015/0157136 | A1 * | 6/2015 | Alzoubi | A47C 27/20 5/718 |
| 2015/0182030 | A1 * | 7/2015 | Hsu | A47C 23/0515 5/716 |

* cited by examiner

ADJUSTABLE MATTRESS STRUCTURE

BACKGROUND OF THE INVENTION

1. Field of the Invention

The present disclosure relates to an adjustable mattress structure, particularly an mattress structure with an adjustable-firmness mattress body for supporting a user's body curve by means of a distance changed between an adjustable positioning board inside a hollow base and a second encapsulated elastomer.

2. Descriptions of the Related Art

A spring mattress available in the market comprises pads, a spring frame and a mattress encasement. The pads are stacked on the spring frame's top and bottom edges; the mattress encasement covering the pads and the spring frame is a package-like body with an opening. A spring mattress is developed after the spring frame along with the pads stacked on the spring frame's top and bottom edges are placed into the mattress encasement and the opening on the mattress encasement is seamed.

The spring frame in the above spring mattress comprises several barrel-shaped pocket springs, each of which is a tubular body made of non-woven fabric and including a spring internally. As spring units, all adjacent barrel-shaped pocket springs which are arranged lengthwise and widthwise for tubular bodies connected to one another are elastically compressed and deformed under stress applied on the spring frame upward and downward. As such, the spring frame which matches the body curve of a user lying down a spring mattress is elastically deformed.

The spring frame, however, is poorly adjusted because all spring units which refer to a user's body curve for elastic deformation perform identical elasticity rather than flexibly adjusted elasticity based on a user's sleeping preference or habit at a mattress surface. Thus, elastomers compressed inside a conventional spring mattress on which a user's weight is sustained do not support a user effectively.

To overcome the above problem, a preferable solution in the present disclosure indicates a mattress structure is divided into several lengthwise components in which a distance between an adjustable positioning board and an encapsulated elastomer is adjusted so that a user's body curve is flexibly supported by elasticity at different positions on a mattress body.

The relevant patent applications submitted by the patent applicant were U.S. Pat. No. 7,934,277, U.S. Pat. No. 8,516,635, U.S. Pat. No. 8,375,492, U.S. Pat. No. 8,893,336, U.S. Pat. No. 8,613,119, U.S. Ser. No. 14/145,542 and U.S. Ser. No. 14/557,910.

SUMMARY OF THE INVENTION

The present disclosure describes an adjustable mattress structure based on a plurality of well-arranged hollow bases, each of which accommodates an adjustable positioning board at a distinct height for a relative distance between the adjustable positioning board and a second encapsulated elastomer and adjustable elasticity of elastic support units supporting a body curve.

An adjustable mattress structure has a mattress body which comprises: a plurality of hollow bases arranged for development of the length and the width of the mattress body wherein each of the hollow bases has a top surface with openings thereon and an anterior side with another opening, is internally connected through the openings, and comprises several slide seats located on both lateral walls and symmetrically arranged from top to bottom; a plurality of elastic support units, each of which consists of a first encapsulated elastomer and a second encapsulated elastomer wherein the first encapsulated elastomer (the second encapsulated elastomer) has a top and a bottom, the second encapsulated elastomer is held inside the first encapsulated elastomer and allows the bottom to extend from the bottom of the first encapsulated elastomer, and the first encapsulated elastomer is arranged and fixed on the hollow base's top surface so that the bottom of the second encapsulated elastomer extends into an opening on the hollow base's top surface; a plurality of adjustable positioning boards, each of which penetrates a hollow base through an opening on the hollow base's anterior side and is positioned and held in slide seats at both sides of the hollow base, located below the bottom of the second encapsulated elastomer, and adjustable in height.

In a preferred embodiment, a first encapsulated elastomer indicates at least a spring wrapped in an encapsulated package and a second encapsulated elastomer indicates at least a spring wrapped in an encapsulated package so that the first encapsulated elastomer and the second encapsulated elastomer match each other at tops and the second encapsulated elastomer is hung in the first encapsulated elastomer.

In a preferred embodiment, a second encapsulated elastomer is greater than a first encapsulated elastomer in length and is less than a first encapsulated elastomer in diameter and a second encapsulated elastomer keeps a certain distance from a first encapsulated elastomer in which the second encapsulated elastomer is held.

In a preferred embodiment, two adjacent hollow bases do not make noise induced by friction because of a spacer member attached to each of the hollow bases.

In a preferred embodiment, an elastic carrier integrated with a hollow base internally has two ends fixed at two opposite sides of the hollow base lengthwise and is situated at the topmost end inside the hollow base and above highest slide seats and used to receive second encapsulated elastomers, which are moving downward and not sinking to the bottom of the hollow base directly, and prevent an adjustable positioning board from slipping into the hollow base completely.

In a preferred embodiment, a positioning slot around an opening at the top surface of a hollow base is used in joining the bottom of a first encapsulated elastomer which is to be peripherally positioned at the opening on the hollow base.

In a preferred embodiment, a clamping member around an opening at the top surface of a hollow base clasps coils of a first encapsulated elastomer near the bottom so that the first encapsulated elastomer is peripherally fixed at the opening of the hollow base.

An adjustable mattress structure has a mattress body which comprises: a plurality of hollow bases arranged for development of the length and the width of the mattress body wherein each of the hollow bases has a top surface with openings thereon and an anterior side with another opening, is internally connected through the openings, and comprises several slide seats located on both lateral walls and symmetrically arranged from top to bottom and two sliding grooves at both sides of openings at the top surface; a plurality of elastic support units, each of which consists of a first encapsulated elastomer and a second encapsulated elastomer wherein the first encapsulated elastomer (the second encapsulated elastomer) has a top and a bottom, the second encapsulated elastomer is held inside the first encapsulated elastomer and allows the bottom to extend from the bottom of the first encapsulated elastomer, and the first encapsulated elastomer is arranged and fixed on the hollow base's top surface so that the bottom of the second encapsulated elastomer extends into an opening on the hollow base's top surface; a spring positioning body with a locating part from which a first elastic fastener and a second elastic fastener at both sides extend wherein the first elastic fastener (the second elastic fastener) is provided with a fastening block at top for development of a fastening space between the first elastic fastener and the second elastic fastener and the spring positioning body further comprises two sliding parts, which protrude from the locating part's bottom, slip into sliding grooves on top surfaces of two adjacent hollow bases, and are fixed beside two openings so that the two adjacent hollow bases are not separated from each other and two adjacent first encapsulated elastomers are positioned in a fastening space in the spring positioning body and securely fixed on top surfaces of hollow bases when the fastening blocks on the first elastic fastener and the second elastic fastener clamp laterals of the adjacent first encapsulated elastomers, respectively; a plurality of adjustable positioning boards, each of which penetrates a hollow base through an opening on the hollow base's anterior side and is positioned and held in slide seats at both sides of the hollow base, located below the bottom of the second encapsulated elastomer, and adjustable in height.

In a preferred embodiment, a spacer member between two sliding parts of a spring positioning body and between two adjacent hollow bases extends downward in order to avoid noise induced by friction between the two adjacent hollow bases.

In a preferred embodiment, sliding parts of spring positioning bodies match sliding grooves which are designed as dove-shaped grooves on hollow bases.

DETAILED DESCRIPTION OF THE PREFERRED EMBODIMENTS

The technical contents, features and effects related to an adjustable mattress structure are clearly presented in preferred embodiments and accompanying drawings.

Figure 1:
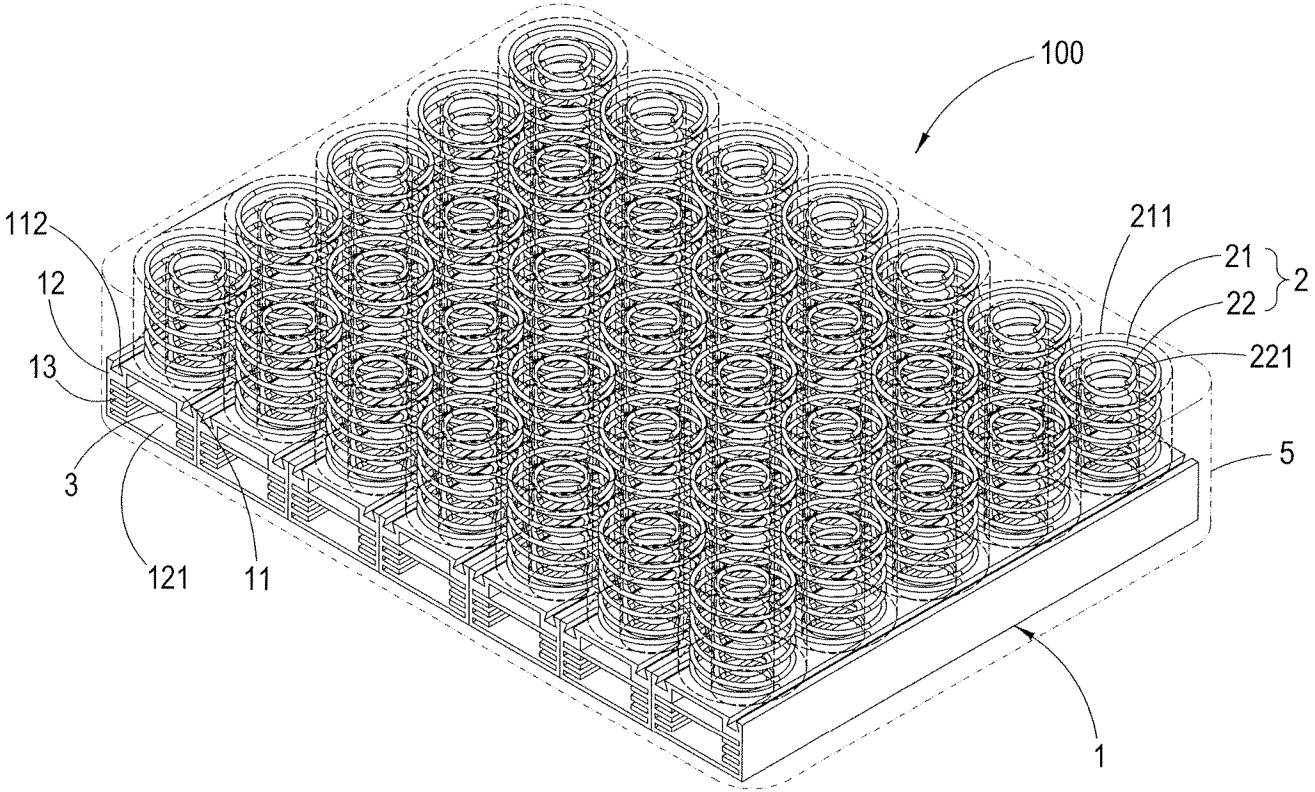
FIG. 1 is a perspective view of an adjustable mattress structure.
Figure 2:
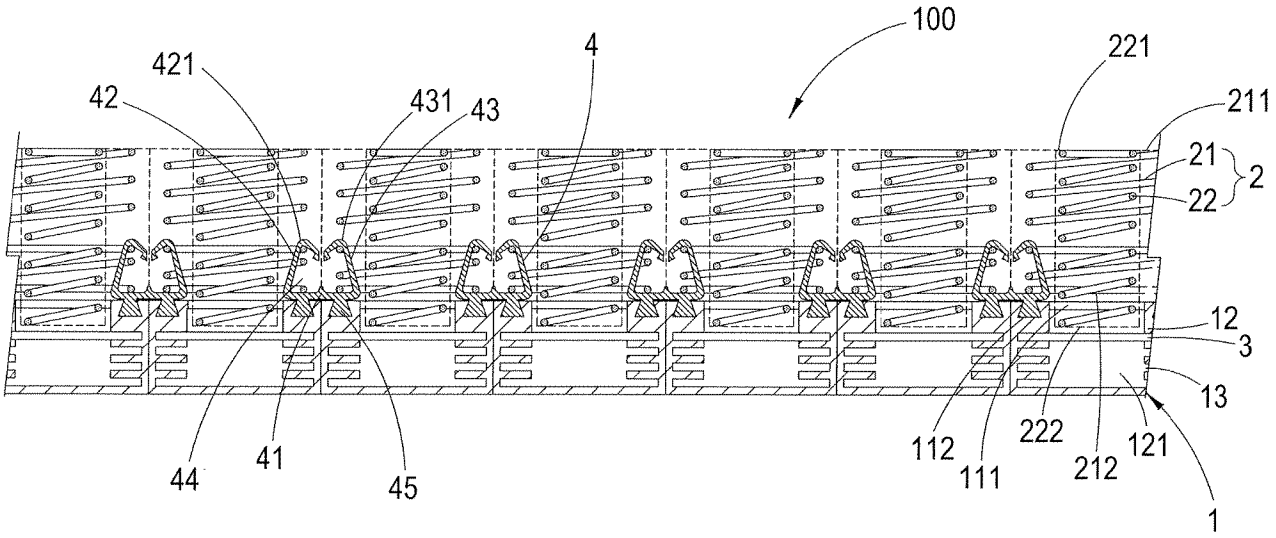
FIG. 2 is a sectional view illustrating partial components of an adjustable mattress structure.
Figure 3:
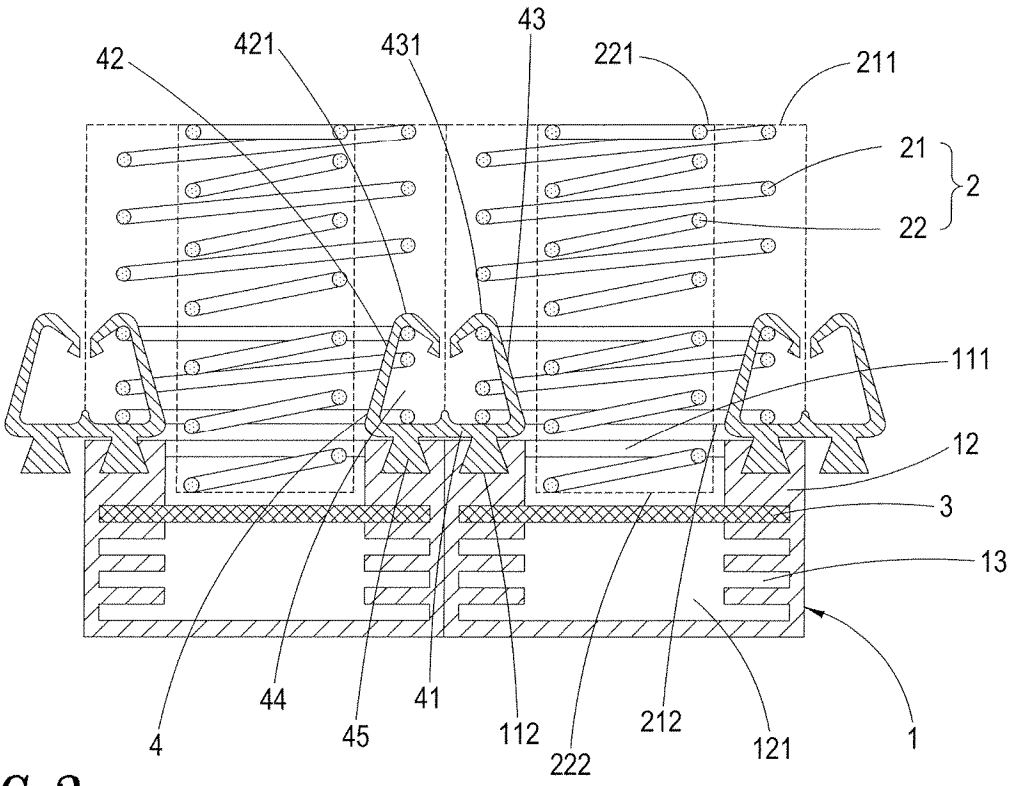
FIG. 3 is a sectional view illustrating partial components of an adjustable mattress structure.

Referring to FIGS. 1, 2 and 3 which illustrate partial components of an adjustable mattress structure. As shown in these figures, the adjustable mattress structure comprises a mattress body 100 in which there are a plurality of hollow bases 1, a plurality of elastic support units 2, a plurality of adjustable positioning boards 3 and a plurality of spring positioning bodies 4. The hollow bases 1 are arranged in place for development of the length and the width of the mattress body 100. Each of the hollow bases 1 has a top surface 11 on which openings 111 are designed and an anterior side 12 on which an opening 121 is designed and is internally connected through the openings 111, 121. At both sides of an opening 111 on the top surface 11 are opened two sliding grooves 112; on both lateral walls inside the hollow base 1 are designed several slide seats 13 symmetrically arranged from top to bottom for development of a positioning mechanism by which an adjustable positioning board 3 is adjusted in height.

As shown in FIGS. 1 to 3, an adjustable positioning board 3, which slips into slide seats 13 through an opening 121 on an anterior side 12 of a hollow base 1, is coupled with and positioned in the slide seats 13 according to an optional height. As such, the adjustable positioning boards 3 in all hollow bases 1 are situated at same or distinct heights.

As shown in FIGS. 1 to 3, an elastic support unit 2 placed on the top surface 11 of a hollow base 1 comprises a first encapsulated elastomer 21 on which there are a top 211 as well as a bottom 212 and a second encapsulated elastomer 22 on which there are a top 221 as well as a bottom 222. The top 221 of the second encapsulated elastomer 22 joins the top 211 of the first encapsulated elastomer 21 so that the second encapsulated elastomer 22 is suspended and positioned in the first encapsulated elastomer 21 and allows the bottom 222 to extend from the bottom 212 of the first encapsulated elastomer 21.

Moreover, second encapsulated elastomers 22 suspended in first encapsulated elastomers 21 are an example in a preferred embodiment which does not limit claims herein. A design of second encapsulated elastomers 22 held in first encapsulated elastomers 21 should be incorporated in claims herein.

As shown in FIGS. 1 to 3, a first encapsulated elastomer 21 (a second encapsulated elastomer 22) illustrates at least a spring is wrapped in an encapsulated package. (In FIGS. 1 to 3, an encapsulated package made of non-woven fabric or other textile materials is indicated with dotted lines in which coil icons as a spring are wrapped.)

The spring positioning body 4 comprises a locating part 41 from which a first elastic fastener 42 and a second elastic fastener 43 at both sides extend: the first elastic fastener 42 and the second elastic fastener 43 at tops are provided with a fastening block 421 and a fastening block 431, respective; the first elastic fastener 42 and the second elastic fastener 43 develop a fastening space in between; the spring positioning body 4 comprises two sliding parts 45 extending from the bottom of the locating part 41. The spring positioning body 4 allows two sliding parts 45 to slip into the sliding grooves 112 on the top surfaces 11 of two adjacent hollow bases 1 and be positioned beside the openings 111 so that the two adjacent hollow bases 1 are not separated from each other. Moreover, the fastening block 421 on the first elastic fastener 42 (the fastening block 431 on the second elastic fastener 43) clasps one side of one in two adjacent first encapsulated elastomers 21 so that the two adjacent first encapsulated elastomers 21 are positioned in the fastening space 44 of the spring positioning body 4. As such, a first encapsulated elastomer 21 is stably fixed on the top surface 11 of a hollow base 1, a second encapsulated elastomers 22 extends into the hollow base 1 through an opening 111 on the top surface of the hollow base 1, and each elastic support unit 2 is positioned on the top surface 11 of a hollow base 1.

When the elastic support unit 2 is placed on the top surface 11 of the hollow base 1, the bottom 212 of the first encapsulated elastomer 21 contacts the top surface 11 of the hollow base 1 and the bottom 222 of the second encapsulated elastomer 22 penetrates the opening 111 on the top surface 11 of the hollow base 1 and is situated above or resisted by the adjustable positioning board 3.

As shown in FIG. 1, two adjacent hollow bases 1, which have been linked and positioned by sliding parts 45 of spring positioning bodies 4 when all elastic support units 2 are placed on top surfaces 11 of the hollow bases 1, combine each other. Based on the above mechanism, a mattress body 100 which is covered with a mattress encasement 5 can be developed finally.

Figure 4:
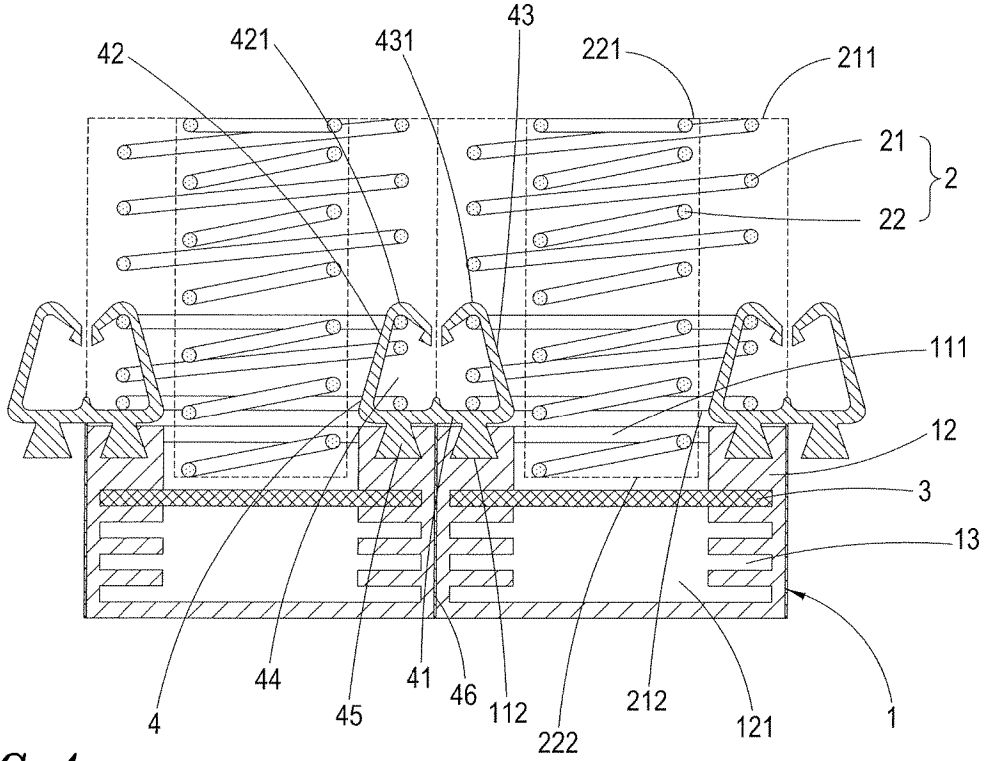
FIG. 4 is a schematic view illustrating a spacer member at a spring positioning body in an adjustable mattress structure.

Referring to FIG. 4 which illustrates a layer of spacer member 46 adheres to two adjacent hollow bases 1 or a layer of spacer member 46 between two sliding parts 45 of a spring positioning body 4 extends downward in order to avoid friction-induced noise between two adjacent hollow bases 1. Other structural components identical to those in FIG. 3 are not further explained.

Figure 5:
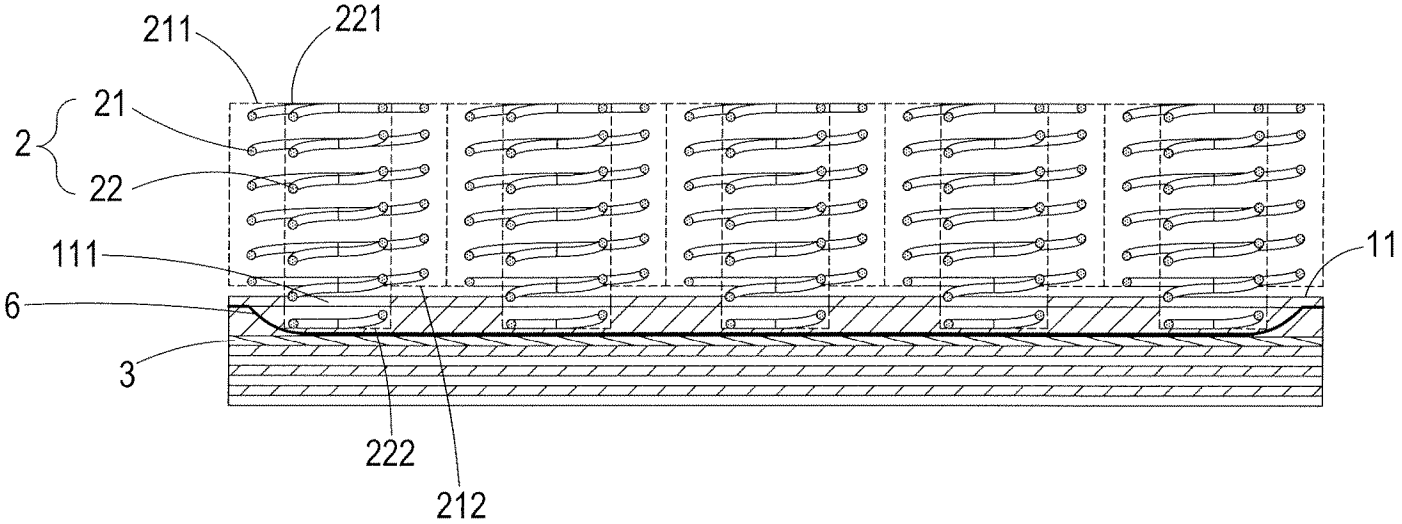
FIG. 5 is a schematic view illustrating an elastic carrier integrated with an adjustable mattress structure.

Referring to FIG. 5. Different from FIGS. 1 to 3, FIG. 5 illustrates an elastic carrier 6 integrated with a hollow base 1 internally has two ends fixed at two opposite sides of the hollow base 1 lengthwise and is situated at the topmost end inside the hollow base 1 and above highest slide seats 13. The elastic carrier 6 is used to receive second encapsulated elastomers 22, which are moving downward and not sinking to the bottom of the hollow base 1 directly, and prevent an adjustable positioning board 3 from slipping into the hollow base 1 completely. Moreover, a second encapsulated elastomer 22 which is pressed downward under stress overcomes elasticity of the elastic carrier 6, keeps moving downward and resists an adjustable positioning board 3 without failure of any initial function. Other structural components identical to those in FIGS. 1 to 3 are not further explained.

Additionally, the sliding parts 45 of spring positioning bodies 4 correspondingly slide inside but do not directly deviate from the sliding grooves 112 which are designed as dove-shaped grooves on the hollow base 1.

Figure 6:
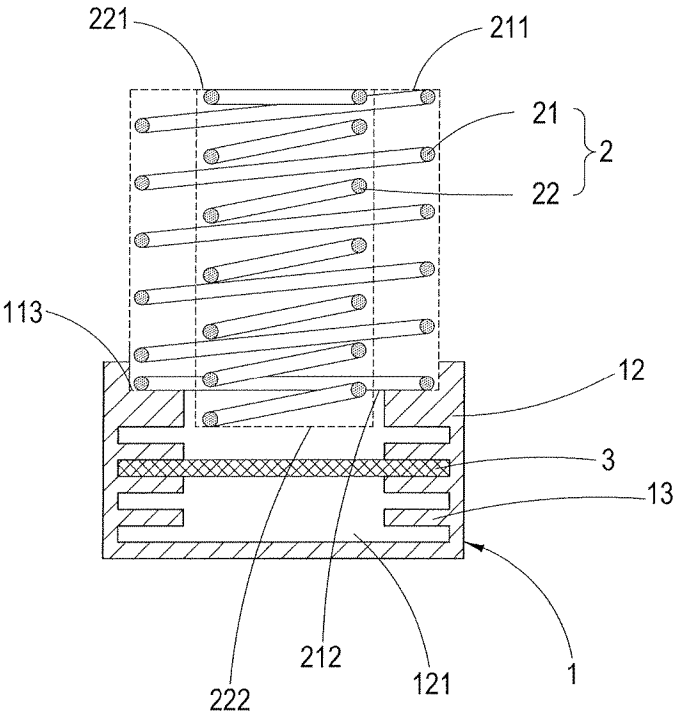
FIG. 6 is a schematic view illustrating an adjustable mattress structure in another embodiment.

Referring to FIG. 6. Different from FIGS. 1 to 3, FIG. 6 illustrates no spring positioning body 4 but a positioning slot 113 around an opening 111 at the top surface 11 of a hollow base 1 directly. The bottom 212 of a first encapsulated elastomer 21 is directly coupled with and positioned in the positioning slot 113 so that the first encapsulated elastomer 21 is peripherally positioned at the opening 111 of the hollow base 1. Other structural components identical to those in FIGS. 1 to 3 are not further explained.

Figure 7:
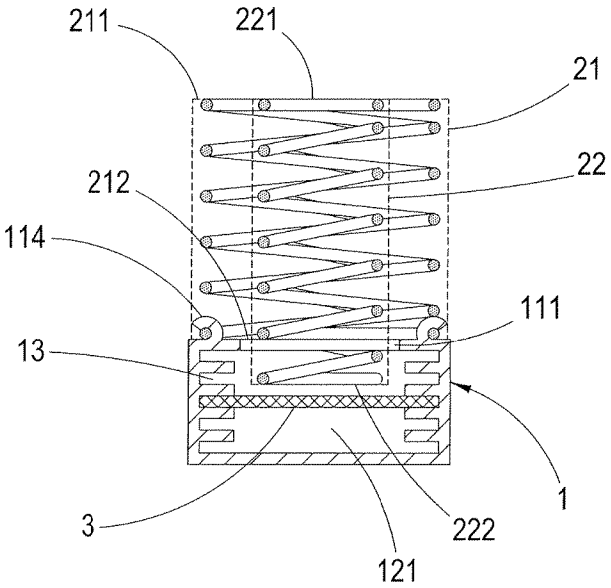
FIG. 7 is a schematic view illustrating an adjustable mattress structure in a further embodiment.

Referring to FIG. 7. Different from FIGS. 1 to 3, FIG. 7 illustrates no spring positioning body 4 but a clamping member 114 around an opening 111 at the top surface 11 of a hollow base 1 directly. The clamping member 114 clasps coils of a first encapsulated elastomer 21 near the bottom 212 so that the first encapsulated elastomer 21 is peripherally fixed at the opening 111 of the hollow base 1. Other structural components identical to those in FIGS. 1 to 3 are not further explained.

Figure 8:
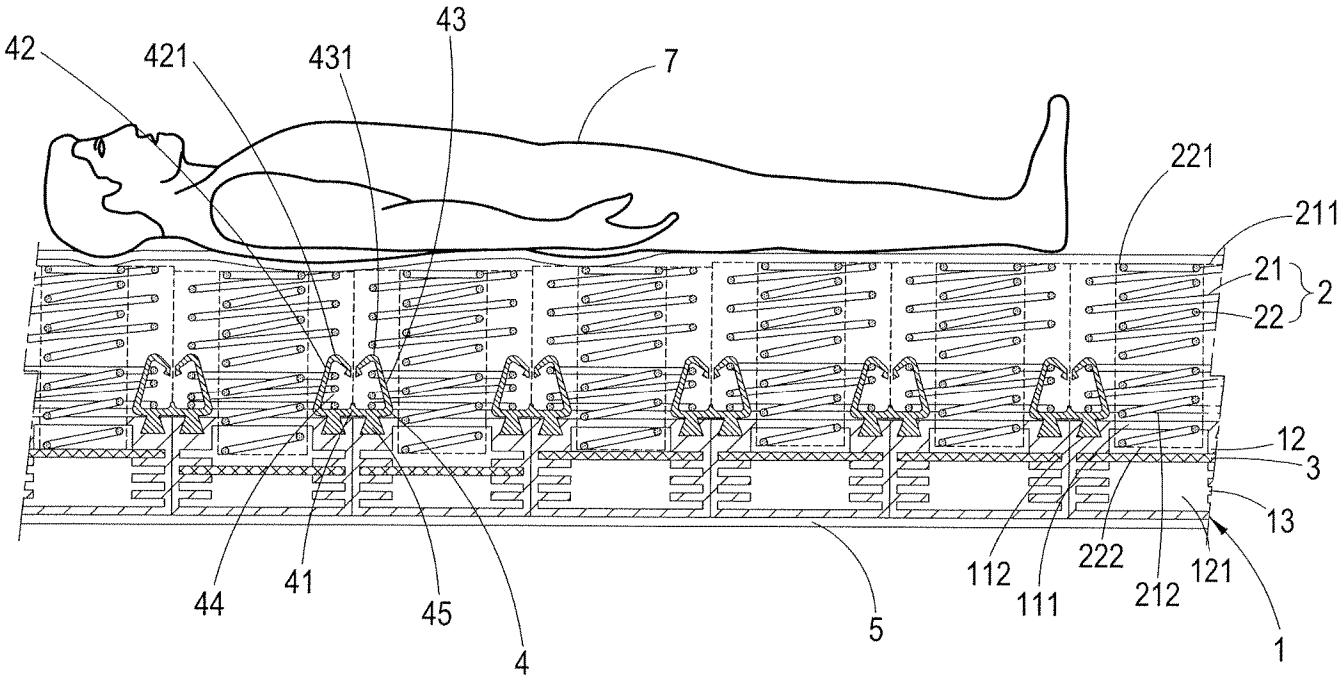
FIG. 8 is a schematic view illustrating an adjustable mattress structure in service.

As shown in FIG. 8, the first encapsulated elastomers 21 of the elastic support units 2 support weight of a user 7 who lies down the mattress body 100, making the second encapsulated elastomers 22 under stress move downward and resist the adjustable positioning boards 3. Because each of the adjustable positioning boards 3 inside one hollow base 1 is manually adjustable in height based on a body curve, distinct positions (areas) on the body of a user 7 correspond to adjustable positioning boards 3 inside hollow bases 1 at different heights: a second encapsulated elastomer 22 is less elastically compressed when stress is propagated from the top 221 of the second encapsulated elastomer 22 which has the bottom 222 close to the adjustable positioning board 3; a second encapsulated elastomer 2 performs different elasticity by which each elastic support unit 2 generates distinct elastic force when a distance between the bottom 222 of the second encapsulated elastomer 22 and an adjustable positioning board 3, which is moved downward and located at a distinct position in a hollow based 1, is increased. As such, a user 7 whose body curve is adjustably supported by the mattress body 100 based on mattress firmness will sleep comfortably.

The preferred embodiments hereof should not be taken as examples to restrict the scope of an adjustable mattress structure in the present disclosure. The equivalent changes and modifications made by the skilled person who familiarizes himself with the above technical features and embodiments without departing from the spirit and scope of the present disclosure should be covered in claims of the patent specification.

What is claimed is:

1. An adjustable mattress structure which has a mattress body comprising:

a plurality of hollow bases arranged along a length and a width of the mattress body wherein each of the hollow bases has a top surface with openings thereon and an anterior side with one opening, and comprises several slide seats located on both lateral walls and symmetrically arranged from top to bottom;

a plurality of elastic support units, each of which consists of a first encapsulated elastomer and a second encapsulated elastomer wherein the first encapsulated elastomer and the second encapsulated elastomer each have a top and a bottom, the second encapsulated elastomer is held inside the first encapsulated elastomer so that the bottom of the second encapsulated elastomer is allowed to extend from the bottom of the first encapsulated elastomer, and each first encapsulated elastomer is arranged and fixed on one of the hollow base's top surface so that the bottom of the second encapsulated elastomer extends into one of said openings on said one of the hollow base's top surface; and a plurality of adjustable positioning boards, each of which penetrates a corresponding one of said plurality of said hollow base through said one opening on the corresponding hollow base's anterior side and is positioned and held in slide seats at both sides of the corresponding hollow base, located below the bottom of the second encapsulated elastomer, each of said adjustable positioning boards being thereby adjustable in height.

2. An adjustable mattress structure according to claim 1 wherein each first encapsulated elastomer includes at least a spring wrapped in an encapsulated package and each second encapsulated elastomer includes at least a spring wrapped in an encapsulated package so that the first encapsulated elastomer and the second encapsulated elastomer have tops at the same height and the second encapsulated elastomer is hung in the first encapsulated elastomer.

3. An adjustable mattress structure according to claim 1 wherein each second encapsulated elastomer is greater than a corresponding first encapsulated elastomer in length and is less than the corresponding first encapsulated elastomer in diameter and the second encapsulated elastomer keeps a certain distance from the corresponding first encapsulated elastomer in which the second encapsulated elastomer is held.

4. An adjustable mattress structure according to claim 1 wherein two adjacent hollow bases are separated by a spacer member attached to each of the hollow bases to reduce noise caused by friction.

* * * * *